US009689264B2

(12) United States Patent
Cocks et al.

(10) Patent No.: US 9,689,264 B2
(45) Date of Patent: Jun. 27, 2017

(54) CENTRIFUGAL FAN IMPELLER WITH VARIABLE SHAPE FAN BLADES AND METHOD OF ASSEMBLY

(71) Applicant: Regal Beloit America, Inc., Beloit, WI (US)

(72) Inventors: Rachele Barbara Cocks, Columbia City, IN (US); Michael R. Hull, Auburn, IN (US); Norman C. Golm, Jr., Fort Wayne, IN (US); Brian L. Beifus, Fort Wayne, IN (US); Zachary Stauffer, Fort Wayne, IN (US); Lisa M. Warriner, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 800 days.

(21) Appl. No.: 13/836,587

(22) Filed: Mar. 15, 2013

(65) Prior Publication Data

US 2014/0356168 A1 Dec. 4, 2014

(51) Int. Cl.
*F03B 3/14* (2006.01)
*F01D 5/14* (2006.01)
(Continued)

(52) U.S. Cl.
CPC ..... *F01D 5/141* (2013.01); *F04D 29/282* (2013.01); *F04D 29/305* (2013.01); *F05B 2230/60* (2013.01); *Y10T 29/49336* (2015.01)

(58) Field of Classification Search
CPC .... F04D 29/281; F04D 29/282; F04D 29/283; F04D 29/305; F05B 2230/60;
(Continued)

(56) References Cited

U.S. PATENT DOCUMENTS 2,370,600 A * 2/1945 Wightman ..... F04D 29/305 416/132 A
D245,426 S 8/1977 Bonifant
(Continued)

FOREIGN PATENT DOCUMENTS

FR 2848260 A1 * 6/2004 ..... F03D 3/0418
IT 232203 Y1 12/1999

OTHER PUBLICATIONS

International Search Report and Written Opinion for PCT/US2014/0234121, dated Sep. 9, 2014, 16 pages.
(Continued)

*Primary Examiner* — Thai Ba Trieu
*Assistant Examiner* — Ngoc T Nguyen
(74) *Attorney, Agent, or Firm* — Armstrong Teasdale LLP

(57) ABSTRACT

In one aspect, a flexible fan blade for use in a centrifugal fan impeller having at least one of a rear plate and a front plate with an air inlet is provided. The flexible fan blade comprises a fixed central portion fixedly coupled to at least one of the front plate and the rear plate of the centrifugal fan impeller. The flexible fan blade also includes a trailing edge extending from the fixed central portion and being moveable between a first position and a second position. The trailing edge is fabricated from a compliant material. Furthermore, the trailing edge is flexible in relation to the fixed central portion between a first position and a second position. The flexible fan blade also includes a leading edge extending from the fixed central portion in opposed relation to the trailing edge.

24 Claims, 8 Drawing Sheets

(51) Int. Cl.
*F04D 29/28* (2006.01)
*F04D 29/30* (2006.01)

(58) Field of Classification Search
CPC F01D 5/027; F01D 5/141; F16F 15/32; F16F 15/28; F05D 2230/60; Y10T 29/49336
USPC ..... 416/144
See application file for complete search history.

(56) References Cited

U.S. PATENT DOCUMENTS 4,150,920 A * 4/1979 Belko ..... B64C 27/008 416/145
4,347,038 A 8/1982 Hayashi et al.
4,662,819 A 5/1987 Lakowske et al.
4,755,105 A 7/1988 Blakeslee et al.
4,900,227 A * 2/1990 Trouplin ..... F03D 9/00 416/240
4,957,414 A 9/1990 Willingham
5,328,330 A 7/1994 Monroe
5,620,306 A 4/1997 Day
5,742,107 A * 4/1998 Asao ..... F04D 29/287 416/135
5,993,158 A * 11/1999 Young ..... F04D 29/305 416/132 A
6,508,627 B2 * 1/2003 Gerken ..... F04D 29/282 29/889.4
6,530,747 B1 * 3/2003 Schneider ..... F16F 15/32 416/144
6,935,835 B2 8/2005 Della Mora
7,942,632 B2 5/2011 Lord et al.
8,047,776 B2 11/2011 Della Mora
8,079,823 B2 * 12/2011 Aynsley ..... F04D 29/384 416/242
2003/0044281 A1 * 3/2003 Kim ..... F04D 29/282 416/243
2003/0099539 A1 * 5/2003 Preinfalk ..... F04D 15/0027 415/12
2004/0005215 A1 1/2004 Della Mora
2008/0298959 A1 12/2008 Della Mora
2010/0115983 A1 * 5/2010 Ikeda ..... F04D 29/281 415/203
2011/0058946 A1 * 3/2011 Sadikovic ..... F04D 29/305 416/205
2012/0093650 A1 * 4/2012 Huber ..... F04D 29/281 416/144
2012/0128494 A1 * 5/2012 Pelley ..... F04D 19/002 416/151

OTHER PUBLICATIONS

"New Comefri Plenum Fan Series with Airfoil Blades: NPA," NPA Brochure, 1 page, Comefri SpA.

* cited by examiner

CENTRIFUGAL FAN IMPELLER WITH VARIABLE SHAPE FAN BLADES AND METHOD OF ASSEMBLY

BACKGROUND

The field of the disclosure relates generally to centrifugal fans and, more specifically, to centrifugal fan impellers with variable shape fan blades for use in air moving applications.

Centrifugal fans generally use one or a combination of three basic fan blade designs: radial, forward curved, and backward curved. Generally, radial bladed fans may have fewer fan blades than forward curved and backward curved designs. In at least some radial bladed fans, the blades extend straight from the axis of rotation of the wheel hub. Typically, radial bladed fans are less efficient than forward curved and backward curved designs. At least some forward curved fans include a large number of fan blades with the blades generally having a short chord length. Forward curved blade designs have fan blades that generally curve in the direction of the wheel hub's rotation. Some forward curved fans are more efficient than radial bladed fans, but less efficient than backward curved fans. Generally, backward curved fans are more efficient than forward curved fans and radial bladed fans. Backward curved fans have fan blades that curve against the direction of the wheel hub's rotation. The blades of a backward curved fan may be flat, slightly curved, or airfoil shaped.

In general, the three basic fan blade designs result in fans with specific performance curves. Typically, a fan's performance curve is determined by the shape of the blades and cannot be altered after the fan is fabricated. As a result, the stable and unstable operating range of the fan is generally fixed. With at least some centrifugal fans, as the flow rate of air through the fan is reduced and the pressure increases, the fan blades may begin to experience stall conditions, i.e., the airflow separates form the surface of the airfoil and changes the pressure distribution to a less favorable condition. A fan with an adjustable blade design may facilitate enlarging the operating range and improving the performance curve of the fan by providing a means for the blade to change to a more favorable geometry for the specified operating point or application and reducing the tendency to stall.

BRIEF DESCRIPTION

In one aspect, a flexible fan blade for use in a centrifugal fan impeller having at least one of a rear plate and a front plate with an air inlet is provided. The flexible fan blade comprises a fixed central portion fixedly coupled to at least one of the front plate and the rear plate of the centrifugal fan impeller. The flexible fan blade also includes a trailing edge extending from the fixed central portion and being moveable between a first position and a second position. The trailing edge is fabricated from a compliant material. Furthermore, the trailing edge is flexible in relation to the fixed central portion between a first position and a second position. The flexible fan blade also includes a leading edge extending from the fixed central portion in opposed relation to the trailing edge.

In another aspect, a flexible fan blade for use in a centrifugal fan impeller having at least one of a rear plate and a front plate with an air inlet is provided. The flexible fan blade comprises a leading edge portion fixedly coupled to at least of one the front plate and the rear plate of the centrifugal fan impeller. In addition, the leading edge portion comprises a leading edge and a trailing edge. Furthermore, the flexible fan blade includes a flap hingedly coupled to the leading edge portion. The flap is rotatable in relation to the leading edge portion between a first position and a second position.

In another aspect, a centrifugal fan impeller is provided. The impeller includes a rear plate including a center axis. In addition, the impeller includes a plurality of flexible fans blades. Each of the flexible fan blades include a fixed portion fixedly coupled to the rear plate of the impeller. Furthermore, each of the flexible fan blades includes a moveable portion extending from the fixed portion, where the moveable portion is moveable between a first position and a second position.

In another aspect, a flexible fan blade for use in a centrifugal fan impeller having at least one of a rear plate and a front plate with an air inlet. The flexible fan blade includes a leading edge fixedly coupled to at least of one the front plate and the rear plate of the centrifugal fan impeller. The flexible blade also includes a trailing edge fixedly coupled to at least of one the front plate and the rear plate of the centrifugal fan impeller. In addition, the flexible fan blade includes a flexible portion extending between the leading edge and the trailing edge and being moveable between a first position and a second position. The flexible portion being fabricated from a compliant material. The flexible portion also being flexible in relation to the leading edge and the trailing edge between the first position and the second position.

In another aspect, a method of assembling a centrifugal fan impeller is provided. The method includes providing at least one of a rear plate and a front plate. In addition, the method includes providing a plurality of flexible fan blades. Each of the flexible fan blades includes a fixed central portion. In addition, the flexible fan blades include a trailing edge extending from the fixed central portion with the trailing edge being fabricated from a compliant material. The trailing edge is also flexible in relation to the fixed central portion between a first position and a second position. The fan blades also include a leading edge extending from the fixed central portion in opposed relation to the trailing edge. The method also includes coupling the plurality of flexible fan blades to at least one of the rear plate and the front plate.

Although specific features of various embodiments may be shown in some drawings and not in others, this is for convenience only. Any feature of any drawing may be referenced and/or claimed in combination with any feature of any other drawing.

DETAILED DESCRIPTION

The present disclosure provides a centrifugal fan impeller with a variable shape fan blade that is configured to dynamically change its shape in response to aerodynamic and centrifugal forces in a manner that improves the overall performance of the centrifugal fan. The dynamic changing in shape of the variable shape fan blade directly affects the aerodynamic coefficients used in the aerodynamic lift and aerodynamic drag equations of an airfoil. Specifically, the centrifugal fan impeller includes a unique fan blade that transforms shape during the fan's use to facilitate improving efficiency, expanding the fan's performance curve, reducing noise, reducing blade stall, and maintaining a uniform volume air flow at different fan speeds. The exemplary variable shape fan blade is self-cleaning and facilitates improving dynamic balancing of the fan. Dynamic balancing of the blades is facilitated by the flexing of blades moving towards a natural forced state which can improve overall balance to the airflow and the inertial balance of the centrifugal fan impeller.

Figure 1:
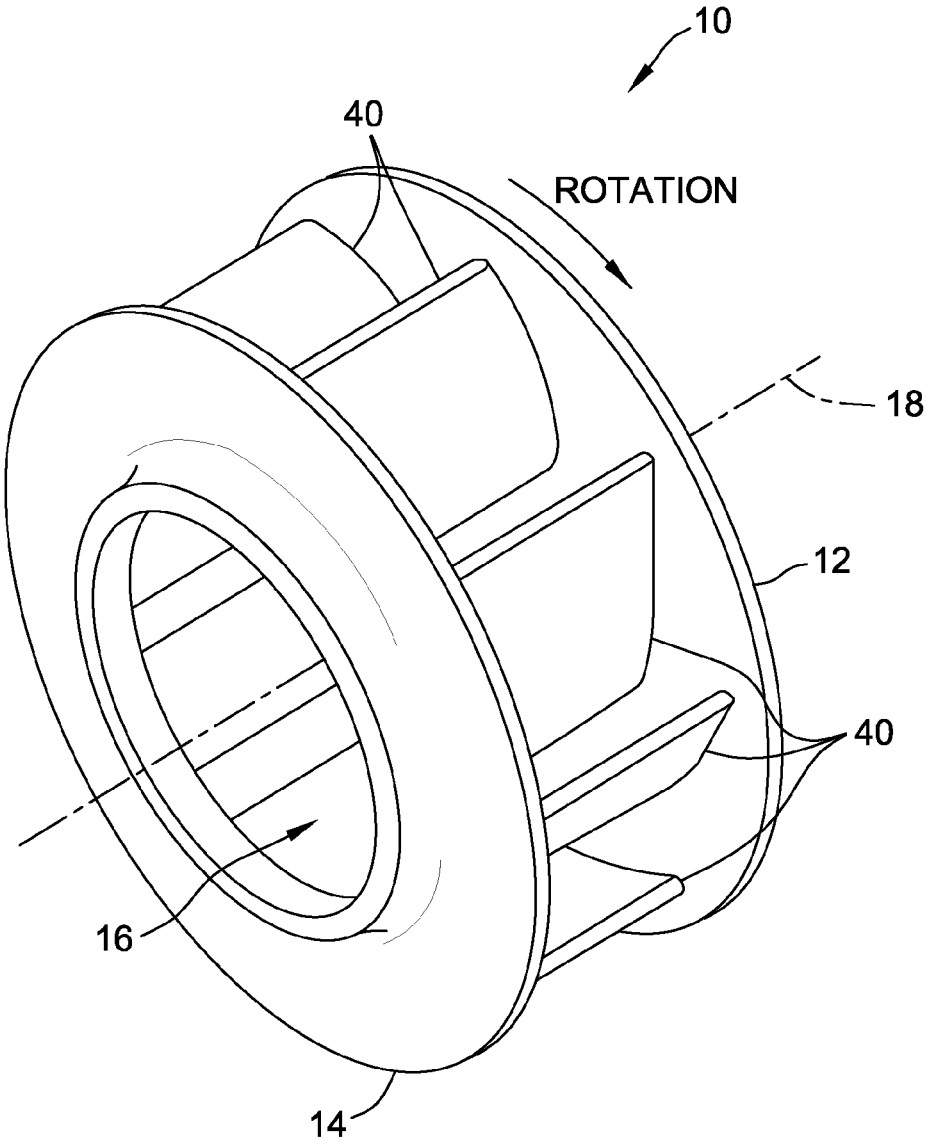
FIG. 1 is a schematic perspective of an exemplary centrifugal fan impeller including variable shape fan blades.

FIG. 1 is a schematic perspective of an exemplary centrifugal fan impeller 10 including variable shape fan blades 30 ("blades"). In the exemplary embodiment, blades 30 are attached between a hub or rear plate 12 and a front plate 14 having a central air inlet 16. Rear plate 12 and front plate 14 are coaxial or substantially coaxial with a center axis 18. Blades 30 are attached to rear plate 12 and/or front plate 14 such that a longitudinal axis of blades 30 is substantially parallel to center axis 18. Blades 30 are configured to pull in air along center axis 18 and eject the air radially outward when rotated about center axis 18 together with rear plate 12 and front plate 14. Blades 30 may be attached to rear plate 12 and/or front plate 14 in any manner that permits fan impeller 10 to operate as described herein. Alternatively, fan impeller 10 may include only one of front plate 14 and rear plate 12. Alternatively, fan impeller 10 may include both fixed blades and variable shape fan blades 30. Fan impeller 10 is configured to produce a flow of air for a forced air system, e.g., a residential HVAC system.

Figure 2:
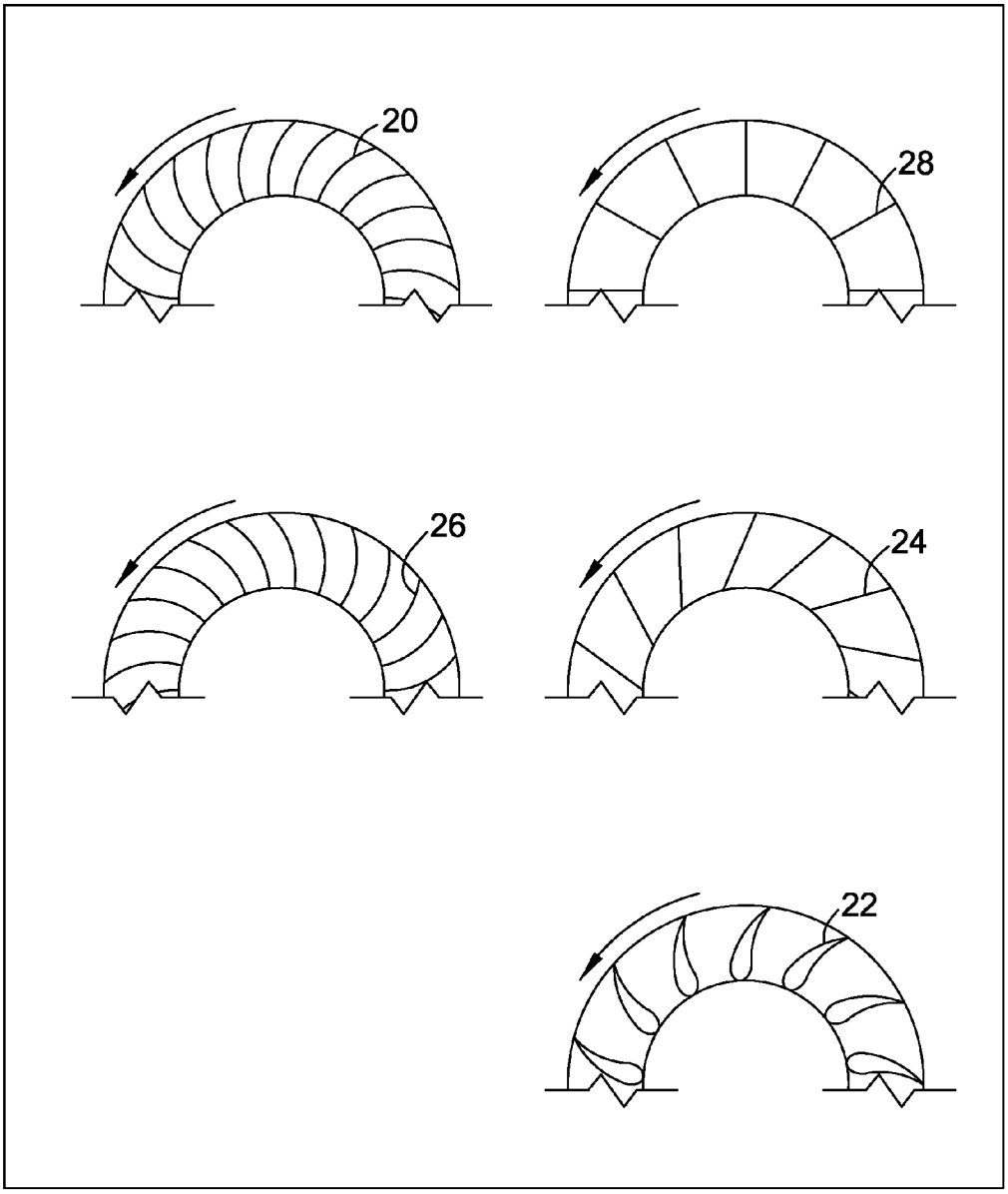
FIG. 2 is an illustration of the different types of centrifugal fan blade designs for the centrifugal fan impeller of FIG. 1.

FIG. 2 illustrates the different type of centrifugal fan blade designs, as discussed above. In some known centrifugal fans, blade shapes include one of a backward curved blade 20, an airfoil blade 22, a backward inclined blade 24, a forward curved blade 26, and a radial blade 28. In the exemplary embodiment, fan impeller 10 is an airfoil blade impeller. Alternatively, fan impeller 10 may have any suitable blade shape, for example a backward included blade 24, that enables fan impeller 10 to operate as described herein.

Figure 3:
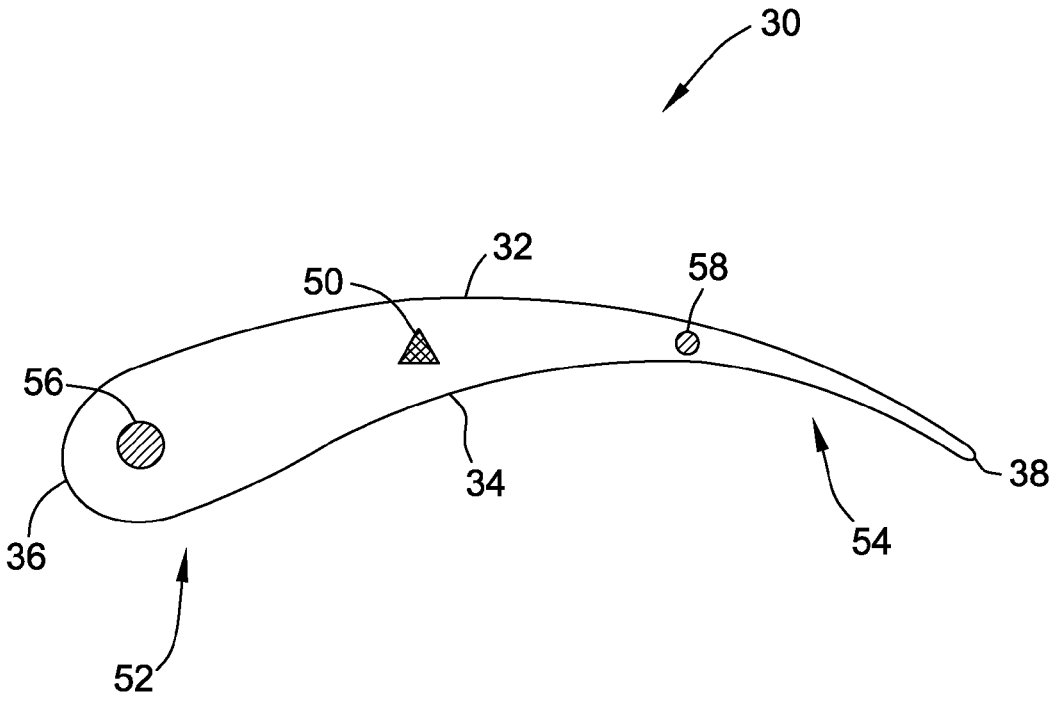
FIG. 3 is a cross-section of the exemplary variable shape fan blade of FIG. 1.

FIG. 3 is a cross-section of an exemplary variable shape fan blade 30 of FIG. 1. Blade 30 may be suitably fabricated from any number of materials, including a plastic or other flexible or compliant material. For example, blade 30 may be formed by a molding, forming, or extruding process used for fabricating parts from thermoplastic or thermosetting plastic materials and/or metals. Alternatively, blade 30 may be fabricated from a combination of materials such as attaching a flexible or compliant material to a rigid material. Blade 30, however, may be constructed of any suitable material, such as metal, that permits blade 30 to operate as described herein.

In the exemplary embodiment, blade 30 has an upper surface 32 and a lower surface 34. Both upper surface 32 and lower surface 34 extend from leading edge 36 to trailing edge 38. As illustrated in FIG. 3, a cross section of blade 30 has an arcuate airfoil shape, i.e., the airfoil shape of blade 30 is generally curved as opposed to being a symmetric airfoil. In the exemplary embodiment, upper surface 32 is generally convex and lower surface 34 is generally concave. Alternatively, blade 30 may be formed, in cross section, as an arcuate blade fabricated from a substantially uniform thickness plate material. In such embodiments, upper surface 32 may be generally convex and lower surface 34 may be generally concave, offset radially from upper surface 32.

Blade 30 includes a fixed portion or mounting location 50, which is generally positioned near the central area of blade 30. Alternatively, mounting location 50 may be positioned in any location along blade 30 that permits blade 30 to operate as described herein. In the exemplary embodiment, mounting location 50 is configured to fixedly attach to rear plate 12 and/or front plate 14 using any suitable fastening means that permits blade 30 to operate as described herein. In one suitable embodiment, blade 30 may attached to rear plate 12 and/or front plate 14 via features formed in rear plate 12 and/or front plate 14 such as an opening, e.g., a groove or a slot, configured to restrict an amount of movement of blade 30 between rear plate 12 and front plate 14 while permitting blade 30 to operate as described herein.

In the exemplary embodiment, blade 30 includes a flexible portion 52 and a flexible portion 54, which are movable relative to fixed mounting location 50. Flexible portion 52 forms at least part of leading edge 36 and flexible portion 54 forms at least part of trailing edge 38. Flexible portions 52 and 54 are fabricated from a compliant material as described above and may also incorporate counterweights or stiffening elements 56 and 58, e.g., fibers, filaments, metals, and the like.

In the exemplary embodiment, when fan impeller 10 is in operation, air enters through central air inlet 16 and is deflected radially outward from central axis 18 of fan impeller 10 towards blades 30. Blades 30 are configured to pull the air from the area of central air inlet 16. The air passes through channels between blades 30 and is forced outwards due to the centrifugal force generated by rotating blades 30. In addition, in some known fans, the volume of airflow forced outwards changes with respect to the speed of the fan's rotation. If the speed of the air passing over the blades drops too low then the lift is lost and the blade stalls. In the exemplary embodiment, blade 30 is configured to vary its shape to facilitate increasing efficiency and reducing the blade's 30 tendency to stall.

Figure 4:
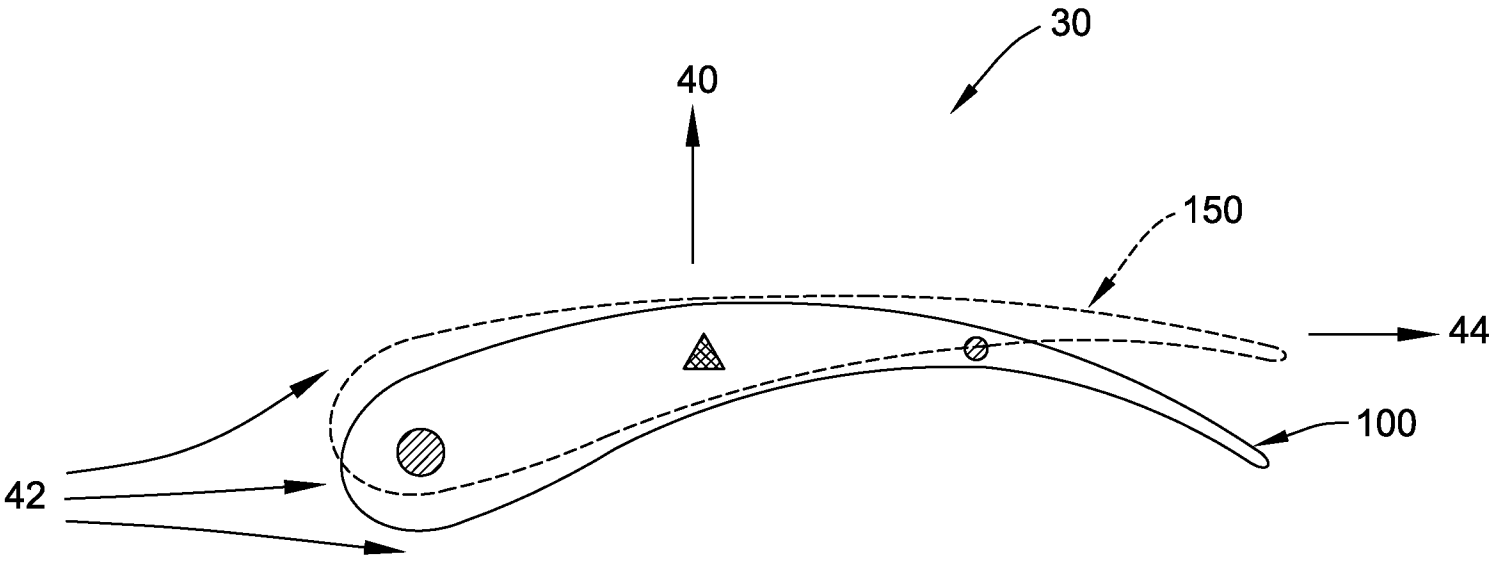
FIG. 4 is a cross-section of the exemplary variable shape fan blade of FIG. 1 illustrating the variable shape positions of the blade.

FIG. 4 is a cross-section of the exemplary variable shape blade 30 of FIG. 1 illustrating the variable shape positions of blade 30. A first position 100 of blade 30 is indicated by the solid lines of FIG. 4. First position 100 is configured to facilitate increasing efficiency of fan impeller 10 when operating at low rotation speed. In addition, first position 100 is configured to facilitate reducing reverse wheel motion from exterior or alternative air sources when the fan is not being operated, i.e., reducing "windmilling.". Furthermore, first position 100 is configured to increase the lift 40 associated with blade 30 at low rotation speed. The term "lift," as used herein, refers to aerodynamic lift. Lift 40 is the component of aerodynamic force perpendicular to the direction of motion of an airflow 42 over blade 30. Increasing lift 40 associated with blade 30 facilitates increasing the volume of airflow 42 generated by fan impeller 10 and reduces the stall speed of fan impeller 10. Stalling of blade 30 causes blade 30 to vibrate, this can lead to noise associated with fan impeller 10. If the vibration continues or is severe enough, it may cause structural damage to fan impeller 10.

Further, first position 100 increases the aerodynamic drag 44 associated with blade 30. The term "aerodynamic drag," as used herein, refers to the component of aerodynamic force parallel to the direction of motion of airflow 42 over blade 30. Increasing aerodynamic drag 44 requires more torque to rotate fan impeller 10 resulting in a greater disparity of the torque requirement at low rotation speed as compared to reduced aerodynamic drag. The greater torque requirement disparity facilitates increasing the control of fan impeller 10 at low rotation speed. An increase in the torque necessary to operate fan impeller 10 at low rotation speed enables a motor controller (not shown) of a motor (not shown) of fan impeller 10 to execute more control over the motor torque at the low rotation speed. The ability to depart from the standard force relations to modifiable force relations on blade 30 facilitates increasing the ability to control the airflow 42 more precisely.

In the exemplary embodiment, as fan impeller 10 is operated, centrifugal forces and air pressure forces generated by the rotation of fan impeller 10 causes flexible portions 52 and 54 of blade 30 to move outward from the axis of rotation of fan impeller 10. As blade 30 changes shape, the moment of inertia of fan impeller 10 also changes. The changes in the blade's 30 shape facilitates dynamically balancing an inertial balance of fan impeller 10, which can help reduce vibration of fan impeller 10.

In the exemplary embodiment, flexible portions 52 and 54 generally move about the mounting location 50 of blade 30. Blade 30 continues to change its shape until fan impeller 10 has reached a maximum operating speed, at which point blade 30 has reached a second position 150 indicated by the dashed lines of FIG. 4. Second position 150 is configured to facilitate increasing efficiency of fan impeller 10 when operating at its maximum operating speed. In one suitable embodiment, second position 150 is configured to decrease the amount of camber of blade 30. Reducing the camber of blade 30 facilitates maintaining attached airflow 42 to upper surface 32 and lower surface 34 of blade 30 and reducing the tendency of blade 30 to stall at the operating speed of fan impeller 10. As described above, stalling of blade 30 causes blade 30 to vibrate, which can lead to noise associated with fan impeller 10. Second position 150 also decreases the lift associated with blades 30, which facilitates maintaining a uniform volume flow rate of air generated by fan impeller 10 in relation to the volume of air generated at lower fan speeds.

Figure 6:
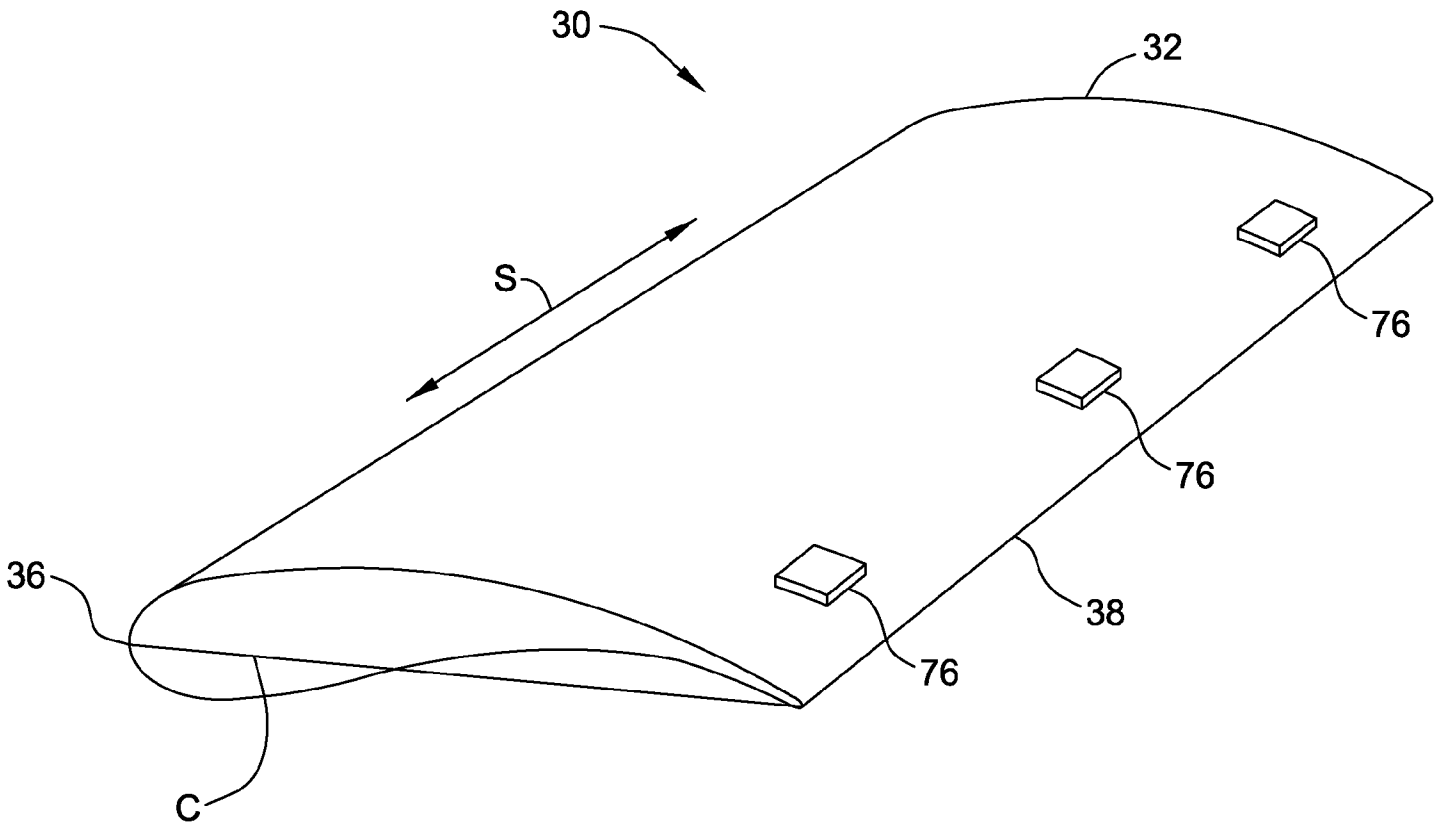
FIG. 6 is an isometric view of the variable shape blade of FIG. 3.

In the exemplary embodiment, the speed and amount that flexible portions 52 and 54 move is controlled by stiffening elements 56 and 58, and/or, with reference to FIG. 6, a plurality of counterweights 76. Stiffening elements 56 and 58, and counterweights 76 and be configured to control the overall shape of blade 30. The position of counterweight 76 are adjustable to adjust an amount of movement of flexible portions 52 and 54. Alternatively, counterweights 76 may be slidably mounted to blade 30 such that as fan impeller 10 rotates, the position of counterweights 76 can move in a predetermined path. Blade 30 can be configured to change its shape in a variety of configurations. In one suitable embodiment, blade 30 can be configured to change its shape along a span S of blade 30. Blade 30 can also be configured to change an amount of camber and the location of camber of blade 30 along chord C. In another suitable embodiment, blade 30 may change shape along span S and along C together. In another suitable embodiment, blade 30 may be configured to twist along the blade's 30 span S. Alternatively, blade 30 may be configured to change shape in any manner that permits blades 30 to operate as described herein.

Figure 5:
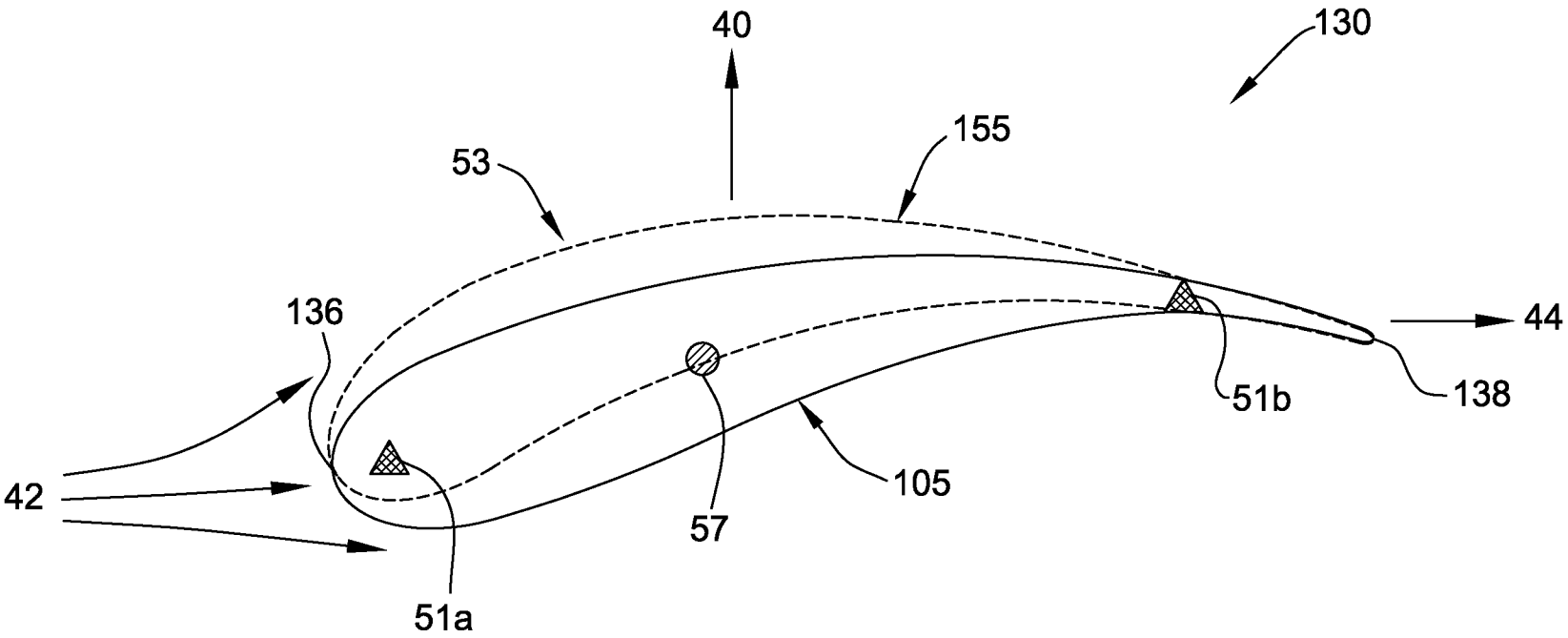
FIG. 5 is a cross-section of an alternative embodiment of a variable shape blade illustrating the variable shape positions of the blade.

FIG. 5 is a cross-section of an alternative embodiment of a variable shape blade 130 illustrating the variable shape positions of blade 130. Blade 130 may include a forward mounting location 51*a* and a rear mounting location 51*b*, which are generally positioned near the leading edge 136 and trailing edge 138, respectively. Alternatively, mounting locations 51*a* and 51*b* may be positioned in any location along blade 130 that permits blade 130 to operate as described herein. Mounting locations 51*a* and 51*b* are configured to attach to rear plate 12 and/or front plate 14 using any suitable fastening means that permits blade 130 to operate as described herein. In one such embodiment, blade 130 may attached to rear plate 12 and/or front plate 14 via features formed in rear plate 12 and/or front plate 14 such as an opening, e.g., a groove or a slot, configured to restrict an amount of movement of blade 130 between rear plate 12 and front plate 14 while permitting blade 130 to operate as described herein.

Blade 130 includes a flexible portion 53, which is movable relative to mounting locations 51*a* and 51*b* between a first position 105 indicated by the solid lines of FIG. 5, and a second position 155 indicated by the dashed lines. Flexible portion 53 includes substantially all of blade 130. Flexible portion 53 is fabricated from a compliant material as described above and may also incorporate a stiffening element 57, e.g., fibers, filaments, metals, and the like. The camber of blade 130 can change to modify the lift 40 and aerodynamic drag 44 of blade 130, thus affecting an amount of airflow 42 and torque necessary to move blade 130. The change in shape of blade 130 creates a change to the performance of centrifugal fan impeller 10 when there is a change to the external forces on centrifugal fan impeller 10. This results in a change in the rotational speed and/or external forces on blade 130. The change in rotational speed and/or external forces on blade 30 effects a change in the shape of blade 130, e.g., the camber and maximum camber location. The changes in shape of blade 130 alters the performance of centrifugal fan impeller 10, resulting in a change in the torque requirement, airflow performance, and/or efficiency such that centrifugal fan impeller 10 responds to the external changes with less variation in the amount of airflow 42.

Figure 7:
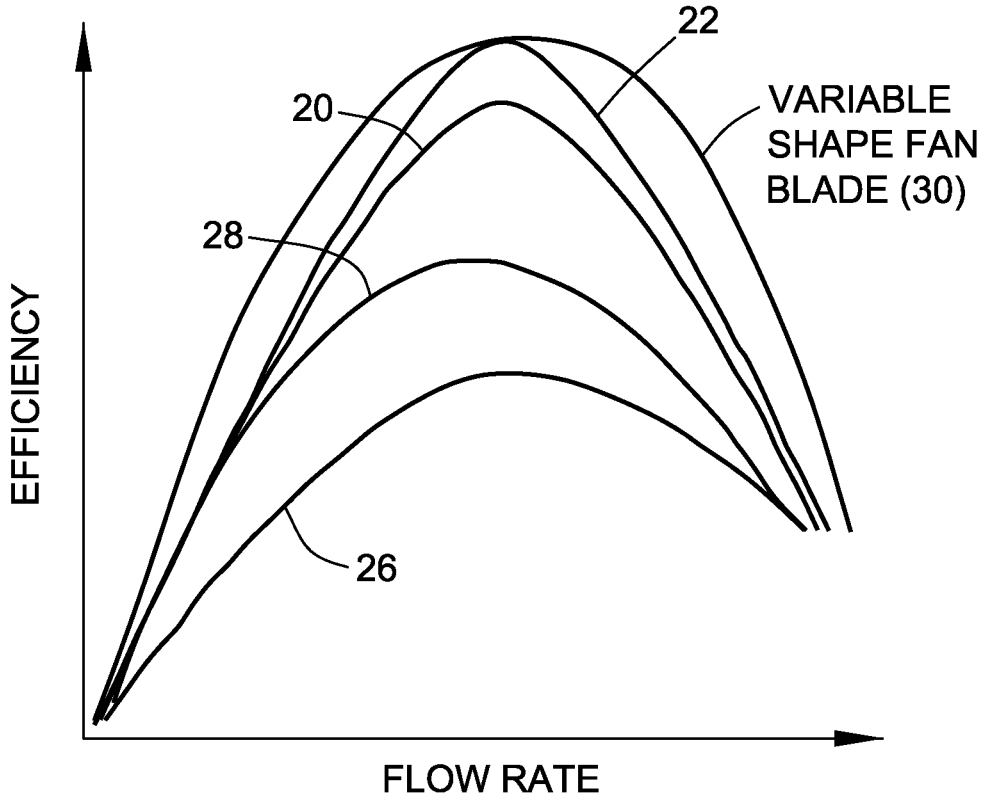
FIG. 7 is a schematic diagram illustrating centrifugal fan performance characteristics and efficiency based on blade type.

FIG. 7 is a schematic diagram illustrating example centrifugal fan performance characteristics and efficiency based on blade type. As described above, a centrifugal fan with airfoil blades 22 is typically more efficient than other blade types. In the exemplary embodiment, as shown in FIG. 6, blade 30 expands the performance curve of fan impeller 10 by changing shape to facilitate increasing efficiency throughout the operating range of fan impeller 10.

Figure 8:
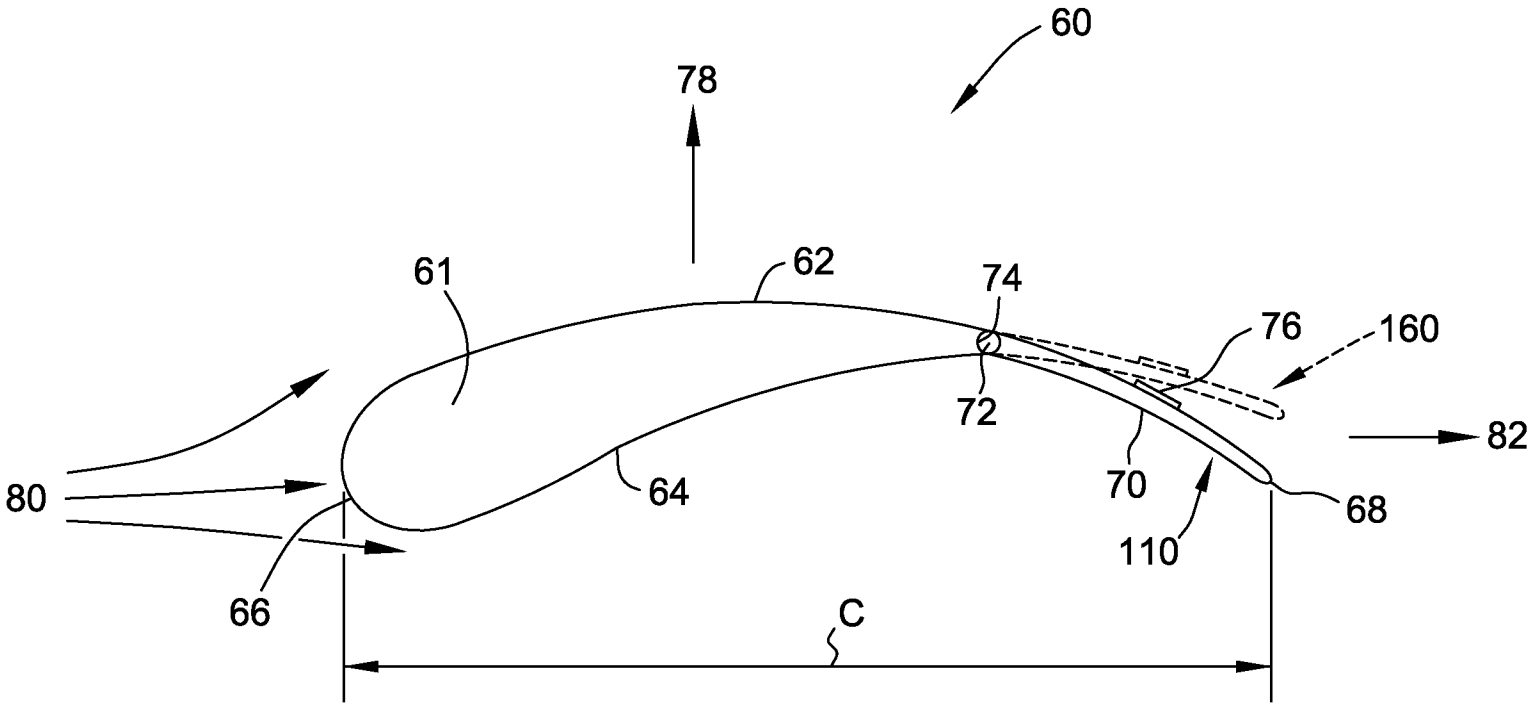
FIG. 8 is a cross-section of an alternative variable shape fan blade for use with the centrifugal fan impeller of FIG. 1.

FIG. 8 is a cross-section of an alternative variable shape fan blade 60 for use with centrifugal fan impeller 10 of FIG. 1. Blade 60 may be suitably fabricated from any number of rigid materials, including a plastic or a metal. For example, blade 60 may be formed by a molding or forming process used for fabricating parts from thermoplastic or thermosetting plastic materials. Alternatively, blade 60 may be fabricated from metal via machining, extruding, or the like. Blade 60, however, may be constructed of any suitable material that permits blade 60 to operate as described herein.

In the exemplary embodiment, blade 60 has an upper surface 62 and a lower surface 64. Both upper surface 62 and lower surface 64 extend from leading edge 66 to trailing edge 68. As illustrated in FIG. 8, a cross section of blade 60 has an arcuate airfoil shape, i.e., the airfoil shape of blade 60 is generally curved as opposed to a symmetric airfoil. In the exemplary embodiment, upper surface 62 is generally convex and lower surface 64 is generally concave. Alternatively, blade 60 may be formed, in cross section, as an arcuate blade fabricated from a substantially uniform thickness plate material. In such embodiments, upper surface 62 may be generally convex and lower surface 64 may be generally concave, offset radially from upper surface 62.

In the exemplary embodiment, blade 60 includes a flap 70 and a leading edge portion or fixed airfoil 61. Fixed airfoil 61 includes leading edge 66 and trailing edge 68. Flap 70 extends from trailing edge 68 and includes approximately 5% to 50% of the chord length C of blade 60. Alternatively, flap 70 may have a length that is 5% to 50% of the overall length of blade 60, where blade 60 is not an airfoil shape. Flap 70 includes flap trailing edge 71 and is movable relative to fixed airfoil 61 of blade 60. Flap 70 is suitably hinged to fixed airfoil 61, such as by a mechanical hinge 72 or other suitable hinge configuration to permit hinged movement of flap 70 between a first position 110 and a second position 160 while maintaining connection of flap 70 with fixed airfoil 61. Alternatively, flap 70 may be attached by a living hinge (or a plurality of living hinges) in which a continuous piece of material formed integrally with flap 70 and fixed airfoil 61 defines the hinge. In other embodiments, flap 70 may be attached to fixed airfoil 61 by any means that permits flap 70 to operate as described herein.

Flap 70 is biased toward first position 110. In the exemplary embodiment, a torsional spring 74 is coupled between fixed airfoil 61 and flap 70 to bias flap 70 to first position 110 about hinge 72. Optionally, flap 70 may have a counterweight 76 coupled to a portion of flap 70 to facilitate biasing flap 70 toward first position 110, the position of counterweight 76 being adjustable to change an amount of bias applied to flap 70. Alternatively, flap 70 may be biased toward first position 110 using any suitable bias component that permits flap 70 to operate described herein.

A first position 110 of blade 60 is indicated by the solid lines of FIG. 8. As described above with respect to blades 30, first position 110 of blade 60 is configured to facilitate increasing the efficiency of fan impeller 10 when operating at lower speeds. In addition, first position 110 is configured to increase the lift 78 associated with blade 60 at lower fans speed. Increasing lift 78 facilitates increasing the volume of airflow 80 generated by fan impeller 10 and reduces the stall speed of fan impeller 10. Stalling of blade 60 may cause blade 60 to vibrate, which can lead to noise. The vibration of blade 60 may cause structural damage to fan impeller 10. Further, first position 110 increases the aerodynamic drag 82 associated with blade 60. Increasing aerodynamic drag 82 requires more torque to rotate fan impeller 10 resulting in a greater disparity of the torque requirement at low rotation speed as compared to reduced aerodynamic drag. The greater torque requirement disparity facilitates increasing the control of fan impeller 10 at low rotation speed. An increase in the torque necessary to operate fan impeller 10 at low rotation speed enables a motor controller (not shown) of a motor (not shown) of fan impeller 10 to execute more control over the motor at the low speed. The ability to depart from the standard force relations to modifiable force relations on blade 60 facilitates increasing the ability to control the airflow 42 more precisely.

In operation, centrifugal forces generated by the rotation of fan impeller 10 causes flap 70 to rotate about hinge 72 toward second position 160. Alternatively, flap 70 may be actively controlled, e.g., flap 70 may be rotated by an electric motor or other active control mechanism. In the exemplary embodiment, flap 70 rotates about hinge 72 until fan impeller 10 has reached a maximum operating speed, at which point flap 70 has reached second position 160 indicated by the dashed lines of FIG. 8. Second position 160 is configured to facilitate increasing efficiency of fan impeller 10 when operating at its maximum operating speed. Second position 160 is configured to decrease the amount of camber of blade 60. As described above, reducing the camber of blade 60 facilitates maintaining attached airflow 80 to upper surface 62 and lower surface 64 of blade 60 and reducing the tendency of blade 60 to stall at the operating speed of fan impeller 10. As previously described, stalling of blade 60 causes blade 60 to vibrate, which can lead to noise and damage to fan impeller 10. Second position 160 also decreases the lift associated with blades 30, which facilitates maintaining a uniform volume flow rate of air generated by fan impeller 10 in relation to the volume of air generated at lower fan speeds.

An exemplary method of assembly fan impeller of FIG. 1 is provided herein. The method includes providing a rear plate 12 (Shown in FIG. 1). In addition, the method includes providing a plurality of variable shape fan blades 30 (Shown in FIG. 3). Blades 30 include a flexible portion 52 and a flexible portion 54, which are movable relative to fixed mounting location 50. Blades 30 are configured to change shape duration operation of fan impeller 10. The method further includes coupling the blades to rear plate 12.

The apparatus and methods described herein provide a centrifugal fan impeller with variable shape fan blades that are configured to change shape to facilitate increasing the efficiency of a centrifugal fan. Moreover, the benefits derived from the unique fan blades include expanding the fan's performance curve, reducing noise, reducing blade stall, and maintaining a uniform volume of air flow at different fan speeds. In addition, the exemplary variable shape fan blade of the impeller is self-cleaning and facilitates improving dynamic balancing of the fan. The exemplary embodiments described herein provide apparatus and methods particularly well-suited for residential HVAC systems.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of assembling a centrifugal fan impeller comprising:

providing at least one of a rear plate and a front plate;

providing a plurality of flexible fan blades, each flexible fan blade including:

a fixed central portion;

a trailing edge extending from the fixed central portion, the trailing edge being flexible in relation to the fixed central portion between a first position and a second position; and a leading edge extending from the fixed central portion in opposed relation to the trailing edge;

coupling a plurality of counterweights to at least one flexible fan blade of the plurality of flexible fan blades such that the plurality of counterweights are adjustable in position to adjust an amount of bias applied to the at least one flexible fan blade, wherein the plurality of counterweights are slidably mounted to an outer surface of the at least one flexible fan blade; and coupling the plurality of flexible fan blades to the at least one of a rear plate and a front plate.

2. The method in accordance with claim 1, wherein coupling the plurality of flexible fan blades includes fixedly coupling the fixed central portion of each of the respective blades of the plurality of flexible fan blades.

3. A centrifugal fan impeller comprising:

a rear plate including a center axis; and a plurality of flexible fan blades, each flexible fan blade including:

a fixed portion fixedly coupled to said rear plate;

a moveable portion extending from said fixed portion, said moveable portion being moveable between a first position and a second position; and a plurality of counterweights coupled to said moveable portion to bias said moveable position toward at least one of said first position and said second position, wherein said plurality of counterweights are mounted to an outer surface of said moveable portion.

4. The centrifugal fan impeller in accordance with claim 3, wherein said rear plate comprises an opening configured to restrict an amount of movement of a respective flexible fan blade of said plurality of flexible fan blades, wherein said respective flexible fan blade of said plurality of flexible fan blades is attached to said rear plate via said opening.

5. The centrifugal fan impeller in accordance with claim 3, wherein said first position is configured to reduce impeller rotation motion from exterior or alternative air sources.

6. The centrifugal fan impeller in accordance with claim 3, wherein each respective flexible fan blade of said plurality of flexible fan blades is configured to dynamically change shape in response to aerodynamic and centrifugal forces generated by said centrifugal fan impeller, wherein the dynamically changing shape of said respective flexible fan blade is configured to balance an airflow over said respective flexible fan blade.

7. The centrifugal fan impeller in accordance with claim 3, wherein each respective flexible fan blade of said plurality of flexible fans blades is configured to dynamically change the moment of inertia of said centrifugal fan impeller.

8. The centrifugal fan impeller in accordance with claim 3, wherein said first position has a first aerodynamic drag, said second position has a second aerodynamic drag, wherein said first aerodynamic drag is greater than said second aerodynamic drag, wherein said first aerodynamic drag is configured to increase the ability to control said centrifugal fan impeller.

9. A flexible fan blade for use in a centrifugal fan impeller having at least one of a rear plate and a front plate with an air inlet, said flexible fan blade comprising:

a fixed central portion fixedly coupled to at least of one the front plate and the rear plate of the centrifugal fan impeller;

a trailing edge extending from said fixed central portion and being moveable between a first position and a second position, said trailing edge being flexible in relation to said fixed central portion between said first position and said second position;

a leading edge extending from said fixed central portion in opposed relation to said trailing edge; and a plurality of counterweights coupled to said trailing edge to bias said trailing edge toward at least one of said first position and said second position, wherein said plurality of counterweights are mounted to an outer surface of said trailing edge.

10. The flexible fan blade in accordance with claim 9, wherein said leading edge and said fixed central portion are fabricated from a rigid material.

11. The flexible fan blade in accordance with claim 9, wherein said leading edge is moveable between a first position and a second position, said leading edge being flexible in relation to said fixed central portion between said first position and said second position.

12. The flexible fan blade in accordance with claim 9, wherein said flexible fan blade is fabricated from a flexible material.

13. The flexible fan blade in accordance with claim 9, wherein said flexible fan blade is formed from a flexible plate having a uniform thickness.

14. The flexible fan blade in accordance with claim 9, wherein said flexible fan blade dynamically changes shape in response to aerodynamic and centrifugal forces generated by the centrifugal fan impeller.

15. The flexible fan blade in accordance with claim 9, wherein said plurality of counterweights are adjustable in position to adjust an amount of bias applied to said flexible fan blade.

16. A flexible fan blade for use in a centrifugal fan impeller having at least one of a rear plate and a front plate with an air inlet, said flexible fan blade comprising:

a leading edge fixedly coupled to at least of one the front plate and the rear plate of the centrifugal fan impeller;

a trailing edge fixedly coupled to at least of one the front plate and the rear plate of the centrifugal fan impeller;

a flexible portion extending between said leading edge and said trailing edge and being moveable between a first position and a second position, said flexible portion being flexible in relation to said leading edge and said trailing edge between said first position and said second position; and a plurality of counterweights coupled to said flexible portion to bias said flexible portion toward at least one of said first position and said second position, wherein said plurality of counterweights are mounted to an outer surface of said flexible portion.

17. The flexible fan blade in accordance with claim 16, wherein said flexible fan blade is formed from a flexible plate having a uniform thickness.

18. The flexible fan blade in accordance with claim 16, wherein said flexible fan blade dynamically changes shape in response to aerodynamic and centrifugal forces generated by the centrifugal fan impeller.

19. The flexible fan blade in accordance with claim 16, wherein said plurality of counterweights are adjustable in position to adjust an amount of bias applied to said flexible portion.

20. A flexible fan blade for use in a centrifugal fan impeller having at least one of a rear plate and a front plate with an air inlet, said flexible fan blade comprising:

a leading edge portion fixedly coupled to at least one of the front plate and the rear plate of the centrifugal fan impeller, said leading edge portion comprising a leading edge and a trailing edge;

a flap hingedly coupled to said leading edge portion, said flap being rotatable in relation to said leading edge portion between a first position and a second position, wherein said flap is biased toward said first position;

a hinge coupling said flap to said leading edge portion such that said flap is rotatable about said hinge; and a torsional spring to bias said flap toward said first position.

21. The flexible fan blade in accordance with claim 20, wherein a length of said flap is between 5% and 50% of a chord length of said flexible fan blade.

22. The flexible fan blade in accordance with claim 20, wherein said hinge comprises a mechanical hinge.

23. The flexible fan blade in accordance with claim 20, further comprising a counterweight coupled to said flap, said counterweight being adjustable in position to adjust an amount of bias applied to said flap.

24. The flexible fan blade in accordance with claim 20, wherein said flexible fan blade is formed from a flexible plate having a uniform thickness.

* * * * *